US010352033B2

(12) United States Patent
Smith et al.

(10) Patent No.: US 10,352,033 B2
(45) **Date of Patent: *Jul. 16, 2019**

(54) CLEARSPAN FABRIC STRUCTURE

(71) Applicant: Mahaffey Fabric Structures, LLC, Memphis, TN (US)

(72) Inventors: George A. Smith, Collierville, TN (US); William C. Sublette, Memphis, TN (US)

(73) Assignee: Mahaffey Fabric Structures LLC, Memphis, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/966,611

(22) Filed: Apr. 30, 2018

(65) Prior Publication Data

US 2018/0245330 A1 Aug. 30, 2018

Related U.S. Application Data

(63) Continuation of application No. 15/078,910, filed on Mar. 23, 2016, now Pat. No. 9,988,805.

(Continued)

(51) Int. Cl.
*E04B 1/19* (2006.01)
*E04B 1/24* (2006.01)

(Continued)

(52) U.S. Cl.
CPC ..... *E04B 1/1903* (2013.01); *E04B 1/342* (2013.01); *E04C 3/06* (2013.01); *E04C 3/28* (2013.01); *E04C 3/32* (2013.01); *E04C 3/36* (2013.01); *E04C 3/40* (2013.01); *E04C 3/46* (2013.01); *E04H 15/10* (2013.01); *E04H 15/18* (2013.01); *E04H 15/54* (2013.01); *E04H 15/644* (2013.01); *E04B 2001/249* (2013.01); *E04B 2001/2415* (2013.01); *E04B 2001/2457* (2013.01);

(Continued)

(58) Field of Classification Search
CPC . E04B 1/1903; E04C 3/04; E04C 3/40; E04C 3/32; E04C 2003/026; E04H 15/10; E04H 15/54; E04H 15/18; E04H 15/34
See application file for complete search history.

(56) References Cited

U.S. PATENT DOCUMENTS 2,666,507 A * 1/1954 Ruark ..... E04B 1/3205 52/639
4,118,904 A * 10/1978 Sprung ..... E04H 15/18 135/119

(Continued)

FOREIGN PATENT DOCUMENTS

FR 2901820 A1 * 12/2007 ..... E04H 15/18

*Primary Examiner* — Rodney Mintz
(74) *Attorney, Agent, or Firm* — Bass, Berry & Sims PLC

(57) ABSTRACT

A clearspan structure including component systems, and methods of forming a clearspan structure including component systems, for mitigating hazards to personnel or equipment from explosions, fires, toxic material release, and other hazards in hazardous locations. The exemplary clearspan structure is also capable of withstanding environmental conditions such as snow loads and wind. The exemplary clearspan structure is, for example, a tent or fabric structure which includes a plurality of frame members forming a support system for the clearspan structure, and fabric roof portions and walls for enclosing the clearspan structure.

9 Claims, 15 Drawing Sheets

Related U.S. Application Data

(60) Provisional application No. 62/137,532, filed on Mar. 24, 2015.

(51) Int. Cl.

| | |
|---|---|
| ***E04B 1/35*** | (2006.01) |
| ***E04C 3/02*** | (2006.01) |
| ***E04C 3/04*** | (2006.01) |
| ***E04C 3/06*** | (2006.01) |
| ***E04C 3/28*** | (2006.01) |
| ***E04C 3/32*** | (2006.01) |
| ***E04C 3/36*** | (2006.01) |
| ***E04C 3/40*** | (2006.01) |
| ***E04C 3/46*** | (2006.01) |
| ***E04B 1/342*** | (2006.01) |
| ***E04H 15/10*** | (2006.01) |
| ***E04H 15/18*** | (2006.01) |
| ***E04H 15/54*** | (2006.01) |
| ***E04H 15/64*** | (2006.01) |

(52) U.S. Cl.
CPC ..... *E04B 2001/2463* (2013.01); *E04B 2001/2487* (2013.01); *E04B 2001/2496* (2013.01); *E04B 2001/3583* (2013.01); *E04C 2003/026* (2013.01); *E04C 2003/043* (2013.01); *E04C 2003/0421* (2013.01); *E04C 2003/0465* (2013.01)

(56) References Cited

U.S. PATENT DOCUMENTS 4,137,687 A * 2/1979 Sprung ..... E04H 15/32 52/222
4,229,914 A * 10/1980 Lucas ..... E04B 1/3441 135/119
4,773,192 A * 9/1988 Andrews ..... E04C 3/40 403/170
4,961,297 A * 10/1990 Bernard ..... E04B 1/34315 52/655.1
4,995,214 A * 2/1991 Wolf ..... E04B 1/26 403/205
5,167,246 A * 12/1992 Mortenson ..... E04H 15/48 135/143
5,333,425 A * 8/1994 Nickerson ..... E04H 15/18 160/383
6,003,280 A * 12/1999 Wells ..... E04B 1/08 52/653.1
6,212,850 B1 * 4/2001 Branson ..... A01K 1/00 119/437
6,247,484 B1 * 6/2001 Thomas ..... E04H 15/18 135/120.3
6,502,593 B1 * 1/2003 Stafford ..... E04H 15/18 135/115
6,691,488 B2 * 2/2004 Branson ..... A01K 1/00 119/437
7,849,639 B2 * 12/2010 Sprung ..... E04C 3/40 135/124
8,082,700 B2 * 12/2011 Kennedy ..... E04B 1/3205 135/124
8,381,452 B1 * 2/2013 Forsland ..... E04B 7/166 4/494
8,528,268 B1 * 9/2013 Reaves ..... E04C 3/42 52/693
8,627,633 B2 * 1/2014 Davies ..... E04B 7/022 52/641
8,931,233 B2 * 1/2015 Cooper ..... E04B 1/24 52/653.1
9,181,723 B2 * 11/2015 Schaefer ..... E04H 15/44
9,988,805 B1 * 6/2018 Smith ..... E04B 1/1903
10,174,507 B1 * 1/2019 Henbid ..... E04F 13/005
2001/0015047 A1 * 8/2001 Branson ..... A01K 1/00 52/745.01
2004/0068938 A1 * 4/2004 Chen ..... A01G 9/14 52/13
2005/0252149 A1 * 11/2005 Ritchey ..... E04B 1/24 52/648.1
2006/0101730 A1 * 5/2006 Sprung ..... E04C 3/40 52/82
2006/0196141 A1 * 9/2006 McLean ..... E04B 1/24 52/643
2006/0277837 A1 * 12/2006 Wilsey ..... E04B 1/161 52/79.1
2008/0178551 A1 * 7/2008 Porter ..... E04B 1/24 52/653.1
2008/0178555 A1 * 7/2008 Green ..... E04C 3/11 52/690
2009/0229645 A1 * 9/2009 Hamilton-Jones ..... E04H 15/18 135/122
2012/0272607 A1 * 11/2012 Cooper ..... E04B 1/24 52/655.1
2013/0042568 A1 * 2/2013 Davis ..... E04B 1/24 52/634
2013/0276382 A1 * 10/2013 Workman ..... E04H 15/44 52/63
2015/0020473 A1 * 1/2015 Fox ..... E04H 15/322 52/712
2015/0184380 A1 * 7/2015 Yamamoto ..... E04C 3/40 52/634
2015/0247316 A1 * 9/2015 Coupe ..... E04B 1/34315 52/650.1
2015/0252586 A1 * 9/2015 Schaefer ..... E04H 15/44 135/121
2016/0298345 A1 * 10/2016 Maintz ..... E04G 21/28

* cited by examiner

CLEARSPAN FABRIC STRUCTURE

CROSS-REFERENCE TO RELATED APPLICATIONS

This application is a continuation application of U.S. patent application Ser. No. 15/078,910, filed Mar. 23, 2016, which claims priority to U.S. Provisional Patent Application No. 62/137,562, filed Mar. 24, 2015.

BACKGROUND

The present disclosure generally relates to a clearspan structure including component systems, and methods of forming a clearspan structure including component systems. For example and without limitation, the present disclosure relates to clearspan tents and fabric structures used to mitigate hazards to personnel or equipment from explosions, fires, and toxic material release, e.g., at refineries, petrochemical plants, chemical operations, natural gas liquids extraction plants, natural gas liquefaction plants, and other facilities such as those covered by Occupational Safety and Health Standards 29 CFR 1910.119, "Process safety management of highly hazardous chemicals" (2013). Among other things, clearspan structures, systems, and methods according to the present disclosure increase the amount of blast impact from which a blast resistant tent may provide protection, provide greater flexibility for locating the clearspan structure on an industrial site, and meet or exceed related industry requirements for recommended practices such as the American Petroleum Institute Recommended Practice 756 (API RP 756), "Management of Hazards Associated with Location of Process Plant Tents."

The disclosed clearspan structures also withstand potentially destructive environmental conditions caused by, for example, winds and snow loads.

BRIEF SUMMARY OF AN EXEMPLARY EMBODIMENT

For purposes of this disclosure, a "clearspan structure" or "clearspan fabric structure" is defined as a structure incorporating a membrane and a structural support system wherein stresses developed in the tensioned membrane interact with those in the structural support so that the entire assembly acts together to resist the applied load, for example as described by the American Petroleum Institute "Management of Hazards Associated with Location of Process Plant Tents," API Recommended Practice 756, First Edition (September 2014).

The present disclosure generally relates to a clearspan structure including component systems, and methods of forming a clearspan structure including component systems, comprising, in an exemplary embodiment and without limitation, a frame comprising steel and aluminum, and a fabric membrane. An exemplary clearspan structure is, for example, a tent or fabric structure capable of withstanding hazards posed in a toxic-thermal blast zone and environmental conditions such as snow loads and wind.

The exemplary embodiment of a clearspan structure includes a plurality of frame members forming a support, also called a truss, system for the clearspan structure. The frame members of the exemplary embodiment comprise, among other things, base plates, upright posts, rafters, brace bars, eave purlins, ridge purlins, ridge struts, and intermediate purlins. In the exemplary embodiment, the base plates are secured to a foundation or the ground, and the upright posts are connected at one end to the base plates and extend vertically upward therefrom to connect with a first end of the rafters. The rafters are further connected at their first ends to eave purlins and extend upward therefrom to connect at their second ends with ridge purlins. Intermediate purlins are connected to the rafters between the eave and ridge purlins.

The exemplary embodiment further includes brace bars and ridge struts for providing additional strength, rigidity, and/or resilience to the frame. The brace bar includes: a brace bar saddle to upright that is connected to a frame member such as an upright post; a hollow structural section connected at one end of the hollow structural section to the brace bar saddle to upright and at another end to a brace bar extension; and, a brace bar saddle to rafter that is connected to each of the brace bar extension and a frame member such as a rafter. The ridge struts include two ridge strut saddles that respectively connect to opposing rafters at the peak of the clearspan structure.

Exemplary disclosed embodiments of a clearspan structure such as a blast tent further include roof fabric and fabric walls formed from double flap keder fabric. The double flap keder fabric provides reinforced protection from forces associated with blasts, wind, and snow, among other things. The roof fabric and fabric walls are respectively connected between adjacent rafters and upright posts to cover and enclose the frame of the clearspan structure. In the exemplary embodiment the roof fabric and fabric walls include keder edges that connect to keder tracks on the frame members.

The exemplary clearspan structure may also include additional components such as cable braces connecting frame members for providing extra strength, rigidity, or other desired properties to the structure; stake bars for distributing forces at base plates to further resist uplift and shear forces, and/or; hanging light assemblies having primary and backup connections to a rafter for preventing the light assembly from detaching and falling.

These and additional objects of the disclosure will be readily apparent to one of ordinary skill in the art, based on the detailed description which follows.

There has thus been outlined some of the features of the structure, systems, and methods, in order that the detailed description thereof may be better understood. One of ordinary skill in the art will understand that the disclosure is not limited in its application to the details of the arrangements, interactions of the components, or steps set forth in the following description or illustrated in the drawings. The structure, systems, and methods are capable of other embodiments, and of being practiced and carried out in various ways, without departing from the scope of the disclosure. Also, it should be understood that the phraseology and terminology employed herein are for the purpose of the description and should not be regarded as limiting.

To the accomplishment of the above and related objects, the structure, systems, and methods may be embodied in the form illustrated in the accompanying drawings, attention being called to the fact, however, that the drawings are illustrative only, and that changes may be made in illustrated structures and systems described within the scope of the disclosure.

BRIEF DESCRIPTION OF THE DRAWINGS

The features and advantages of the exemplary embodiments may be better and more completely understood with reference to the attached drawings in which corresponding reference symbols indicate corresponding parts, and in which.

DETAILED DESCRIPTION OF AN EXEMPLARY EMBODIMENT

Figure 1:
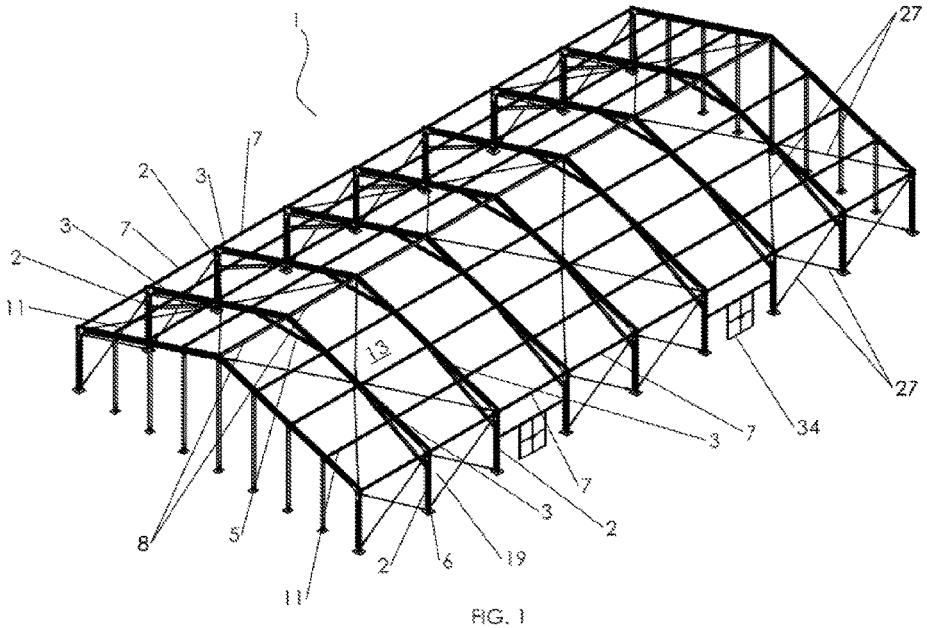
FIG. 1 shows an exemplary embodiment of clearspan structure according to the current disclosure.

With reference now to the drawings, the figures illustrate exemplary embodiment(s) of a clearspan structure including component systems of a clearspan structure. An exemplary method of forming such structure and systems will be apparent to one of ordinary skill in the art based on, for example, the disclosed fabrication, configuration, and fastening of such structure and systems, without limitation thereto.

With reference to FIGS. 1-4, an exemplary embodiment of a clearspan structure 1 is shown. The clearspan structure comprises, among other things, frame members such as upright posts 2, rafters 3, brace bars 4, ridge struts 5, base plates 6, eave purlins 7, ridge purlins 8, and intermediate purlins 11. Further, clearspan structure 1 comprises roof fabrics 13 and fabric walls 19 for enclosing the clearspan structure 1, and, in an exemplary embodiment, fabric doors 34 for providing access to the clearspan structure 1. In addition, the exemplary embodiment of the clearspan structure 1 includes cable braces 27 for providing additional stability to the clearspan structure 1.

With continuing reference to the exemplary embodiment of the exemplary frame for a clearspan structure 1 shown in FIGS. 1-4, each upright post 2 is secured at one end to a base plate 6 which is secured to a foundation or to the ground. In the exemplary disclosed embodiment, upright posts 2 have a 300 mm×100 mm (11.81 inches×3.94 inches) nominal dimension and are spaced at approximately 2.5 m (8.2 feet) increments across the span width of the clearspan structure 1. Other sizes, weights, and spacing for upright posts 2 may be used to achieve particular properties for particular structures.

Figure 5:
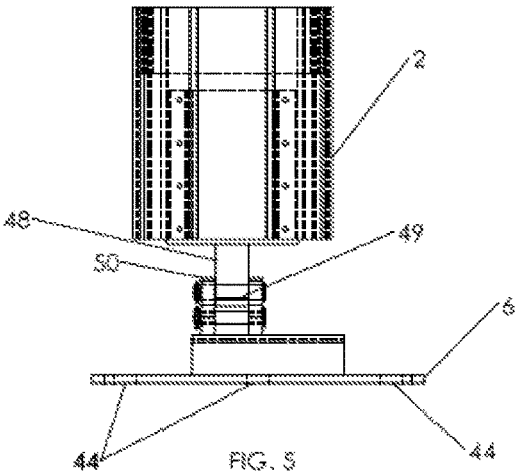
FIG. 5 shows an exemplary base plate connection for the clearspan structure.

In the exemplary embodiment shown by FIG. 5, upright posts 2 are connected to base plates 6 by a steel insert 48 with a guide hole 49. The guide hole 49 fits into a mating slot 50 on the top side of the base plate 6, where a bolt (unnumbered) is inserted through the slot 50 and guide hole 49. In other embodiments, upright posts 2 may be directly connected to base plates 6 using bolts, screws, welding, or other known techniques. Alternatively, upright posts 2 may be integrally formed with base plates 6.

Base plate 6 may be secured to a foundation or to the ground using anchors such as straight stakes and/or helical anchors passed through anchoring apertures 44 (see FIG. 31), embedded systems, concrete anchors (for pads, ringbeams, piers, etc.), mechanical anchors (drop-in or expansion anchor types), chemical anchors, or by any technique consistent with this disclosure and particular ground conditions on site locations.

Upright posts 2 and base plates 6, as well as other frame members indicated above and described in further detail below, are made from steel and/or aluminum in the exemplary disclosed embodiments. In the same or other embodiments, the frame members may be made from other metals, alloys, plastics, or other materials consistent with this disclosure.

With continuing reference to FIGS. 1-4, the upright post 2 extends upward from the base plate 6 and connects at a second end of the upright post 2 to a first end of a rafter 3. With specific reference now to the exemplary embodiment shown in FIG. 3, and further in FIGS. 6-7, each upright post 2 is connected to a rafter 3 using a bracket 35 that spans and connects to each of the upright post 2 and rafter 3. In the exemplary embodiment, brackets 35 are secured to upright post 2 and rafter 3 using bolts 36 that extend through upright post 2 and rafter 3 and secure a second bracket 35 to an opposite side of upright post 2 and rafter 3 using nuts 37. In other embodiments, brackets 35 may be secured using screws, welding, or other known techniques consistent with this disclosure. In still further embodiments, upright post 2 and rafter 3 may be integrally formed.

Figure 2:
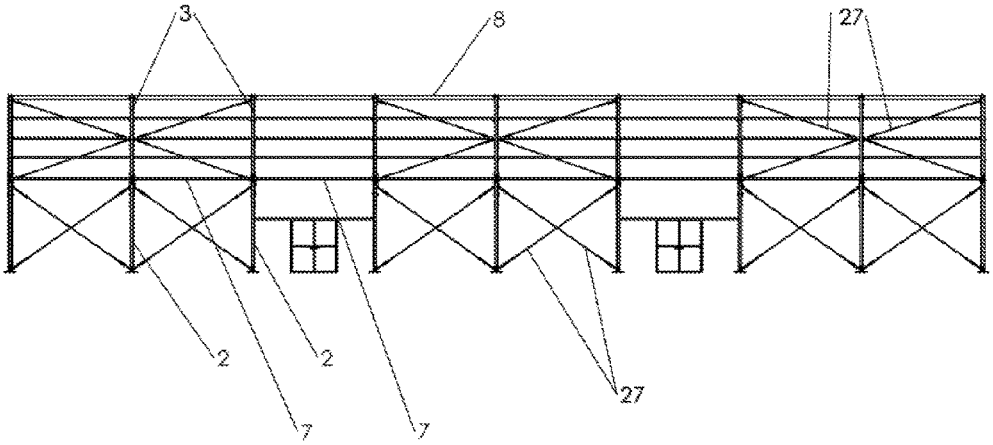
FIG. 2 shows a front view of the exemplary clearspan structure.
Figure 6:
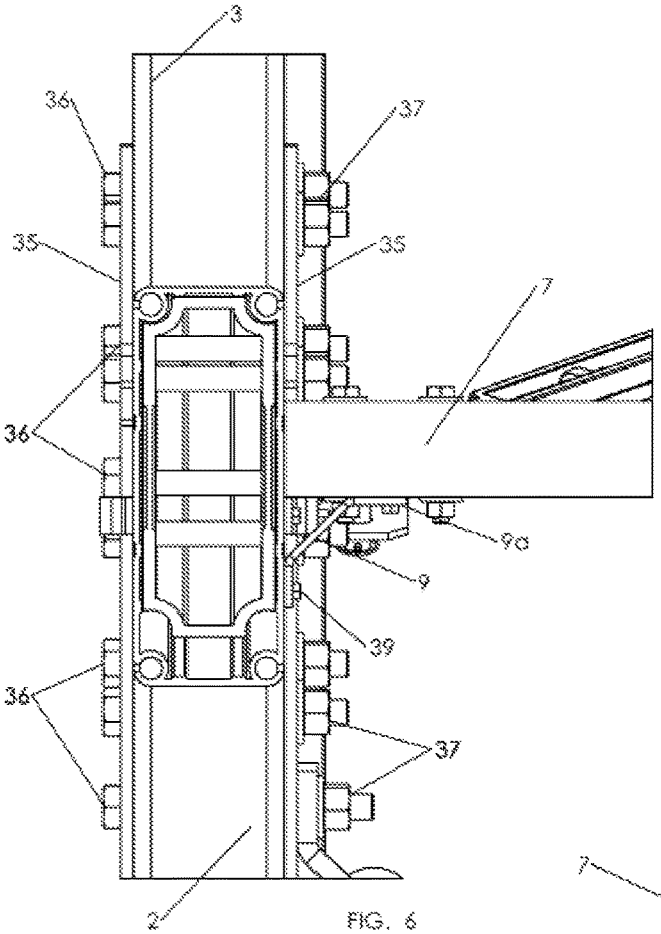
FIG. 6 shows an exemplary connection of a rafter, upright post, and eave purlin for the clearspan structure.
Figure 7:
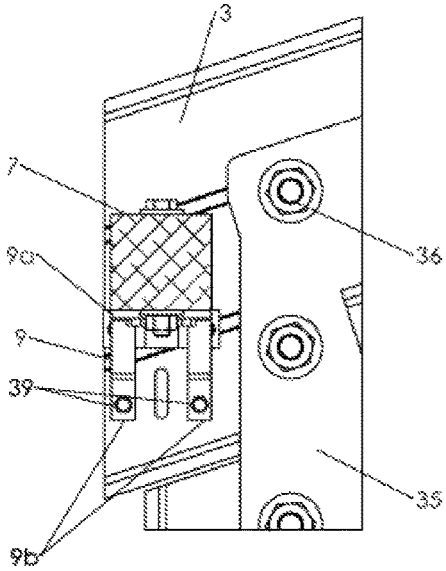
FIG. 7 shows an exemplary eave purlin connection for the clearspan structure.
Figure 8:
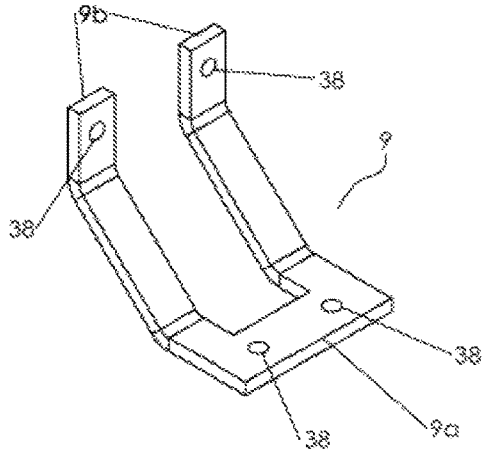
FIG. 8 shows an exemplary eave purlin bracket for the clearspan structure.

With continuing reference to the exemplary embodiments of FIGS. 1-2, and with further reference to FIGS. 6-7, in the exemplary embodiment the first end of each rafter 3 is also connected to an eave purlin 7. An exemplary connection of a rafter 3 to an eave purlin 7 is shown in FIGS. 6-7. Eave purlin 7 abuts rafter 3 and is secured thereto using an eave purlin bracket 9 as shown in FIGS. 6-8. The exemplary eave purlin bracket 9 of FIG. 8 has a bent-U shape and includes fastener apertures 38 for accommodating a fastener such as a screw, bolt, rivet, or other known fastener.

As shown in the view along the rafter 3 of FIG. 6 and the view along the eave purlin 7 of FIG. 7, the exemplary eave purlin bracket 9 is respectively connected to the eave purlin 7 at the base 9*a* of the eave purlin bracket 9 and to the rafter 3 at the arms 9*b* of the eave purlin bracket 9. In the exemplary embodiment, eave purlin bracket 9 is connected to the eave purlin 7 and rafter 3 using self-tapping screws 39 that extend through fastener apertures 38 on the eave purlin bracket 9. In other embodiments, eave purlin bracket 9 may be connected to eave purlin 7 and rafter 3 using any known method consistent with this disclosure, such as welding or clamping.

Figure 3:
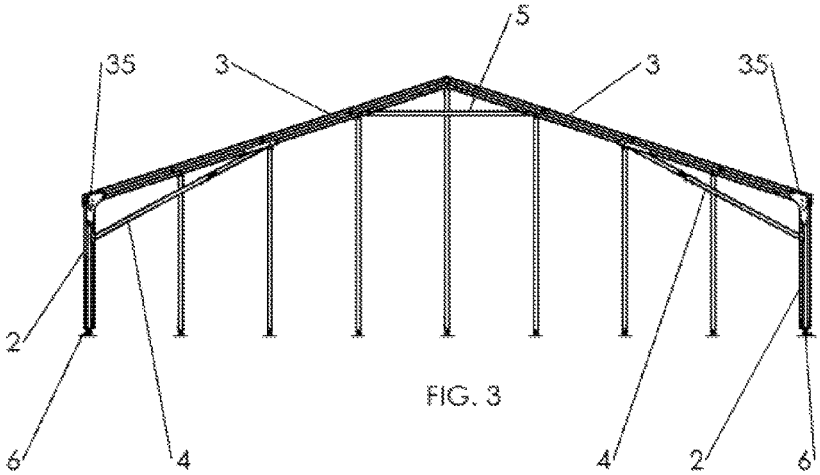
FIG. 3 shows a side view and exemplary frame portion of the exemplary clearspan structure.
Figure 9:
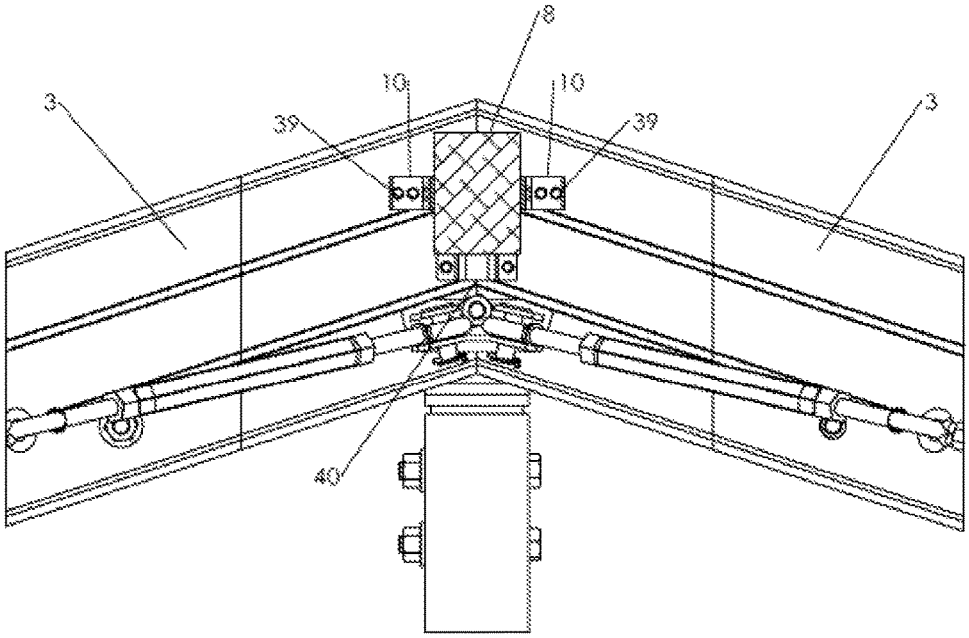
FIG. 9 shows an exemplary ridge purlin connection for the clearspan structure.

With continuing reference to FIGS. 1-3 and the frame of the clearspan structure 1, rafters 3 extend from upright posts 2 and eave purlins 7 to ridge purlins 8. An exemplary connection between rafters 3 and a ridge purlin 8 is shown in FIG. 9. In the view along the ridge purlin 8 of FIG. 9, ridge purlin 8 abuts two rafters 3 which connect at respective ends of the rafters 3. The ridge purlin 8 connects to each rafter 3 using a ridge bracket 10 (FIG. 10) on each of two opposite sides of the ridge purlin 8, and a hook bracket 40 (FIG. 11) in conjunction with a bracket hook 41 (FIG. 12). The rafters 3 may be joined via their connections to the ridge purlin 8, or in any manner consistent with this disclosure, such as with screws, bolts, brackets, welding, clamping, or other known techniques.

Figure 10:
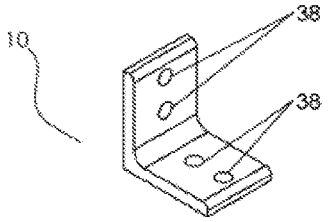
FIG. 10 shows an exemplary ridge purlin bracket for the clearspan structure.

With continuing reference to FIGS. 9-10, in the exemplary embodiment ridge bracket 10 is L-shaped. The exemplary ridge bracket 10 includes fastener apertures 38 for connecting the ridge bracket to each of the ridge purlin 8 and the rafters 3 via self-tapping screws 39 that pass through the fastener apertures 38 of ridge bracket 10. In the exemplary embodiment, one end of ridge bracket 10 is secured to the ridge purlin 8 and the other end of ridge bracket 10 is secured to rafter 3. In other embodiments, ridge bracket 10 may be of any shape or form consistent with this disclosure, and may be secured to ridge purlin 8 and rafter 3 using any known connecting means consistent with this disclosure, such as screws, bolts, welding, clamping, or other known means.

Figure 11:
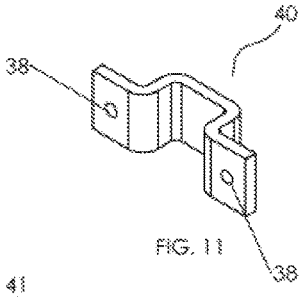
FIG. 11 shows an exemplary hook bracket for the clearspan structure.
Figure 12:
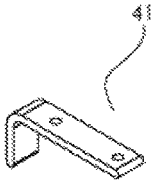
FIG. 12 shows an exemplary bracket hook for the clearspan structure.
Figure 13:
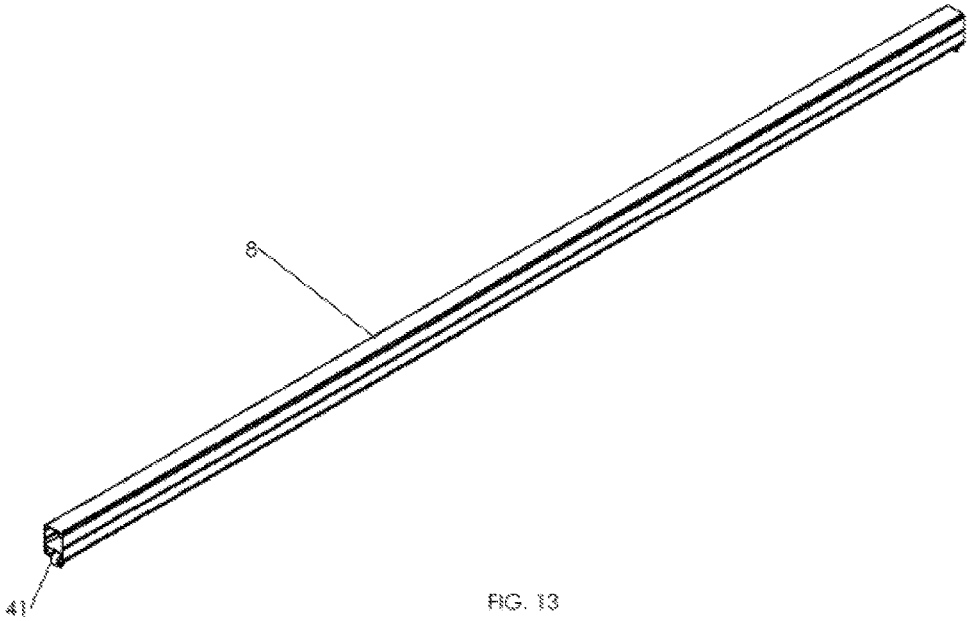
FIG. 13 shows an exemplary ridge purlin for the clearspan structure.

With continuing reference to FIG. 9, and further reference to FIGS. 11-13, an exemplary hook bracket 40 and bracket hook 41 for securing ridge purlin 8 are shown. Bracket hook 41 is connected to, and extends perpendicularly from, ridge purlin 8. Thus, when ridge purlin 8 is connected to rafters 3, the extending portion of bracket hook 41 will be substantially flush with rafters 3 and hook bracket 40 is configured to attach on either side of, and retain, the extending portion of bracket hook 41.

Figure 14:
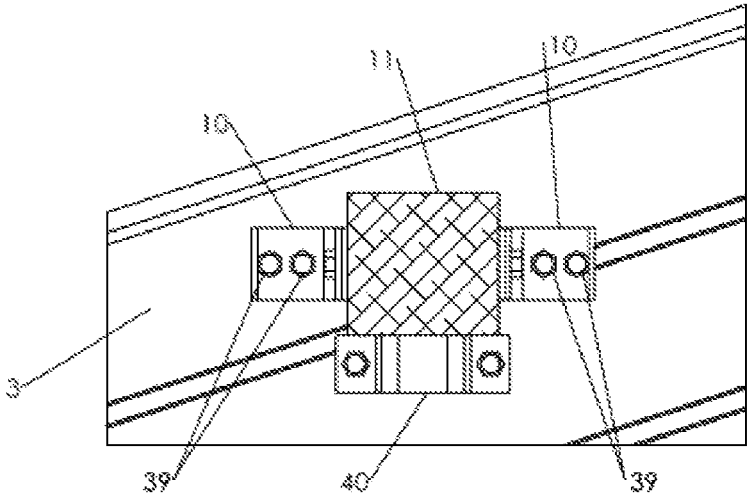
FIG. 14 shows an exemplary intermediate purlin connection for the clearspan structure.

FIG. 14 shows an exemplary connection between an intermediate purlin 11 and a rafter 3. In the exemplary embodiment, intermediate purlin 11 has substantially the same structure as ridge purlin 8 and attaches to rafter 3 using ridge brackets 10, hook bracket 40, and bracket hook 41 in generally the same assembly as previously described with respect to the exemplary connection between the rafters 3 and ridge purlin 8.

Figure 15:
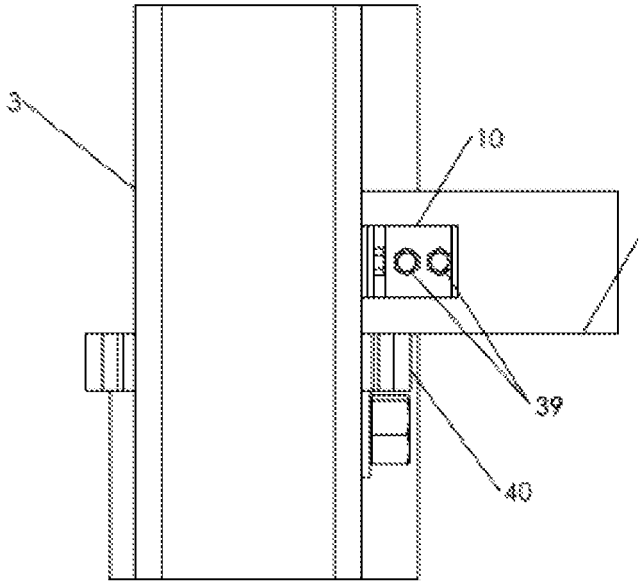
FIG. 15 shows a side view of an exemplary ridge purlin connection for the clearspan structure.

FIG. 15 shows a side view of the exemplary connection between a ridge purlin 8 and rafter 3 as shown in FIG. 9 (and similarly between an intermediate purlin 11 and rafter 3 as shown in FIG. 14).

In the exemplary embodiment(s) described above, eave purlin bracket 6, ridge bracket 9, hook bracket 40, and bracket hook 41 are formed from extruded, hollow aluminum. In the same or other embodiments, any or all of these components may be formed from other metals, alloys, plastics, or other materials consistent with this disclosure.

Figure 4:
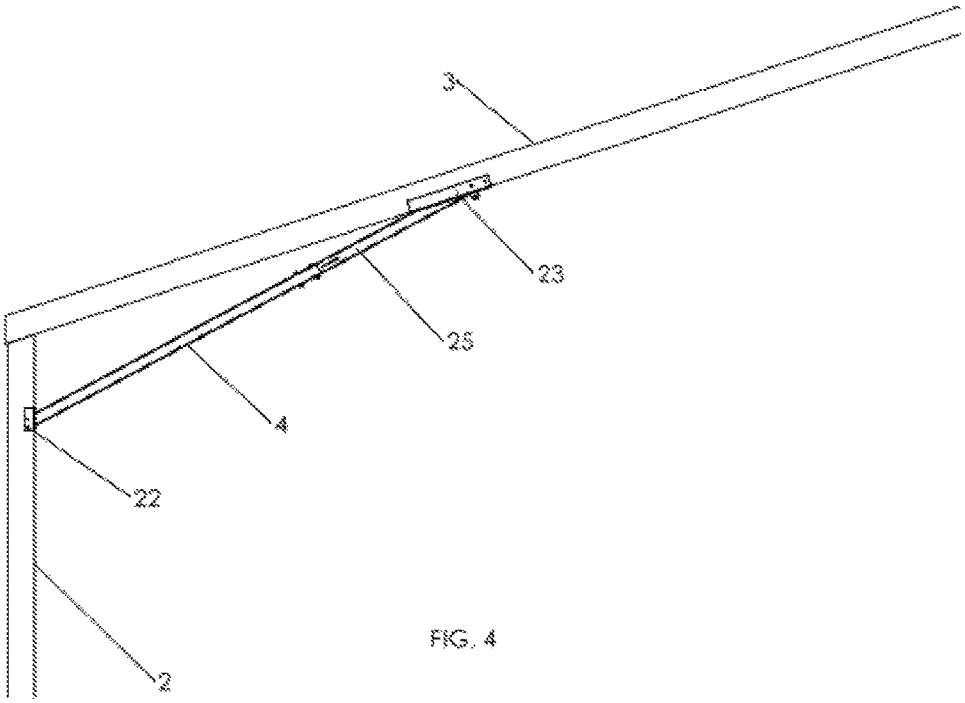
FIG. 4 shows an exemplary brace bar and assembly for the clearspan structure.
Figure 16:
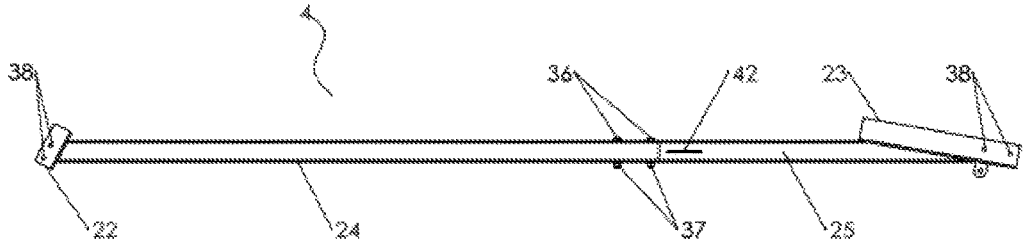
FIG. 16 shows an exemplary brace bar for the clearspan structure.
Figure 17:
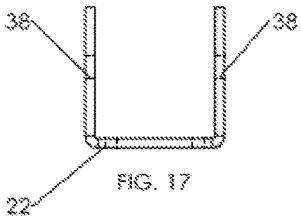
FIG. 17 shows an exemplary brace bar saddle to upright for the clearspan structure.
Figure 18:
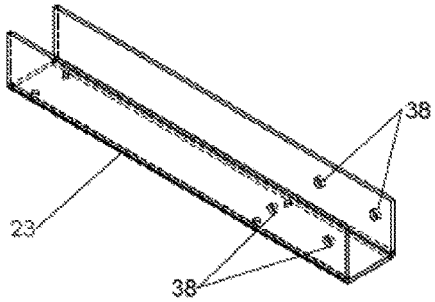
FIG. 18 shows an exemplary brace bar saddle to rafter for the clearspan structure.

With reference now to FIG. 16, and continuing reference to FIGS. 3-4, the exemplary embodiment of a clearspan structure 1 includes brace bars 4 connected between upright posts 2 and rafters 3 for providing additional stability and support to the clearspan structure 1. The exemplary brace bar 4, shown in FIG. 16, includes a brace bar saddle to upright 22 as shown in FIG. 17 for connecting to the upright post 2, and a brace bar saddle to rafter 23 as shown in FIG. 18 for connecting to the rafter 3. The brace bar 4 further includes a hollow structural section 24 connected at a first end to the brace bar saddle to upright 22 and at a second end to a brace bar extension 25. The brace bar extension 25 is further connected to the brace bar saddle to rafter 23. In other embodiments, brace bar saddle to upright 22 and brace bar saddle to rafter 23 may be connected by a single component, for example and without limitation, a hollow structural section or other component consistent with this disclosure that extends between the brace bar saddle to upright 22 and the brace bar saddle to rafter 23.

The exemplary brace bar saddle to upright 22 shown in FIG. 17 has a U-shape. In other embodiments, brace bar saddle to upright 22 may generally have any shape or form consistent with this disclosure. In the exemplary embodiment, the U-shaped brace bar saddle to upright 22 may, for example and without limitation, be connected to each side of a substantially rectangular upright post 2 and secured thereto using screws, bolts, or other known fasteners passed through fastener apertures 38 on brace bar saddle to upright 22. In other embodiments, brace bar saddle to upright 22 may be connected to a frame member by welding, clamping, or other known connecting means, or may be integrally formed with a frame member.

The brace bar saddle to upright 22 is also connected to the hollow structural section 24, as shown in FIG. 16. In the exemplary embodiment shown by FIG. 16, brace bar saddle to upright 22 is welded to the hollow structural section 24 at an appropriate angle to allow attachment of the brace bar saddle to upright 22 to upright post 2. In other embodiments, brace bar saddle to upright 22 and hollow structural section 24 may be connected by bolting, clamping, or other known connecting means, or may be integrally formed.

With continuing reference to FIG. 16, hollow structural section 24 and brace bar extension 25 are connected. As shown in the exemplary embodiment of FIG. 16, hollow structural section 24 and brace bar extension 25 are connected by bolts 36 and nuts 37, and/or by a weld through slot 42 in the hollow structural section 24. In other embodiments, hollow structural section 24 and brace bar extension 25 may be connected by any other known means consistent with this disclosure, or may be integrally formed. In still further embodiments, brace bar extension 25 may be configured to move relative to hollow structural section 24, for example by sliding along a length of hollow structural section 24.

With continuing reference to FIG. 16, brace bar extension 25 extends from hollow structural section 24 and further connects to brace bar saddle to rafter 23. In the exemplary embodiment shown in FIG. 18, brace bar saddle to rafter 23 has an elongate U-shape. In other embodiments, brace bar saddle to rafter 23 may generally have any shape or form consistent with this disclosure. In the exemplary embodiment, the U-shaped brace bar saddle to rafter 23 may be connected to each side of a substantially rectangular rafter 3 and secured thereto using screws, bolts, or other known fasteners passed through fastener apertures 38 on brace bar saddle to rafter 23. In other embodiments, brace bar to saddle to rafter 23 may be connected to a frame member by welding, clamping, or other sufficient connection means, or may be integrally formed with a frame member.

In the exemplary embodiment shown by FIG. 16, brace bar saddle to rafter 23 is welded to the brace bar extension 25 at an appropriate angle to allow attachment of the brace bar saddle to rafter 23 to rafter 3. In other embodiments, brace bar saddle to rafter 23 and brace bar extension 25 may be connected by bolting, clamping, or other known connecting means, or may be integrally formed.

In the exemplary embodiment of brace bar 2 described above, the components of brace bar 2 are made from galvanized steel such as according to standard ASTM A922 ("Standard Specification for Silicon Metal"). In the same or other embodiments, components of brace bar 2 may be made from other metals, alloys, plastics, or other materials consistent with this disclosure.

Figure 19:
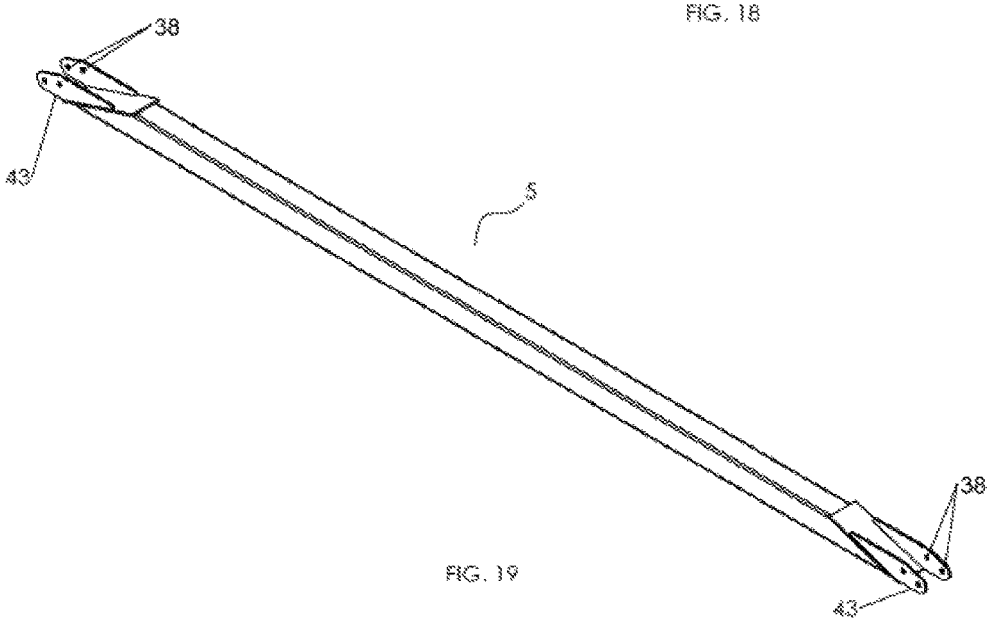
FIG. 19 shows an exemplary ridge strut for the clearspan structure.

With reference now to FIG. 19, and continuing reference to FIG. 3, the exemplary embodiment of a clearspan structure further includes ridge struts 5 connected between opposing rafters 3 for providing additional stability and support to the clearspan structure 1. In the exemplary embodiment of FIG. 19, ridge strut 5 is an elongate strut having a ridge strut saddle 43 at each of first and second ends. As previously shown in FIG. 3, the ridge strut 5 spans and connects to opposing rafters 3 via ridge strut saddles 43 which, in the exemplary embodiment, are U-shaped structures that may fit over opposing sides of a substantially rectangular rafter 3 and be connected thereto by screws or bolts through fastener apertures 38, or by welding or other known connection means. Ridge strut 5 may also be integrally formed with a frame member.

In the exemplary embodiment, components of ridge strut 5 are made from galvanized steel such as according to standard ASTM A922 ("Standard Specification for Silicon Metal"). In the same or other embodiments, components of ridge strut 5 may be made from other metals, alloys, plastics, or other materials consistent with this disclosure. Further, ridge strut 5, and ridge strut saddles 43 may be of any shape or form consistent with this disclosure.

Figure 20:
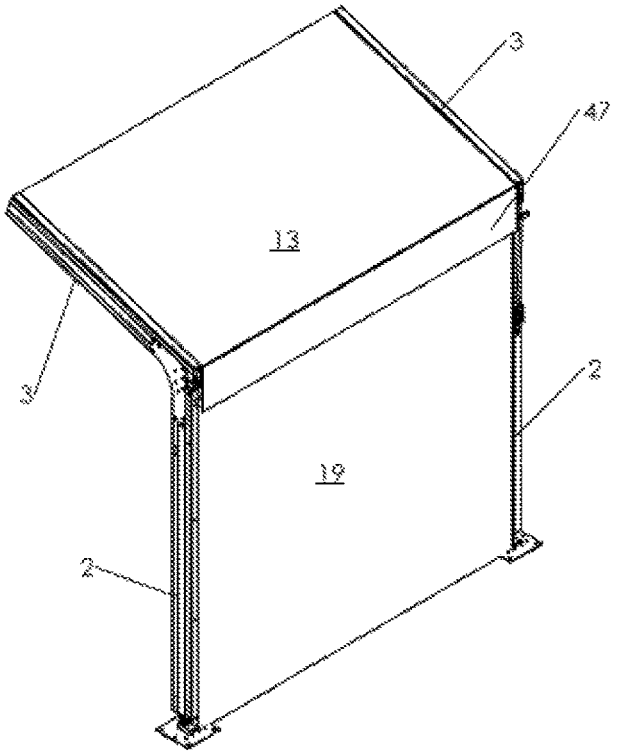
FIG. 20 shows exemplary fabric portions for the clearspan structure.
Figure 21:
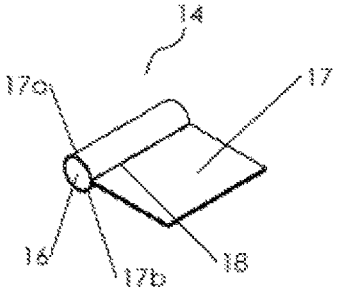
FIG. 21 shows an exemplary fabric for the clearspan structure.
Figure 22:
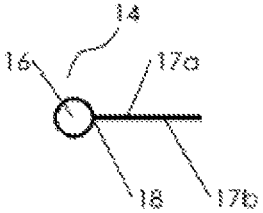
FIG. 22 shows an exemplary fabric for the clearspan structure.
Figure 23:
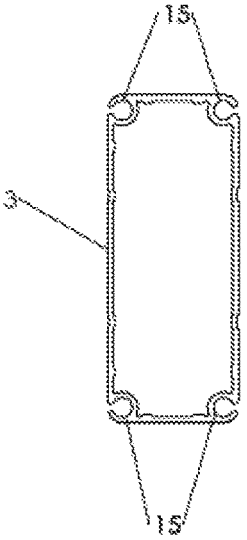
FIG. 23 shows an exemplary fabric connection for the clearspan structure.
Figure 24:
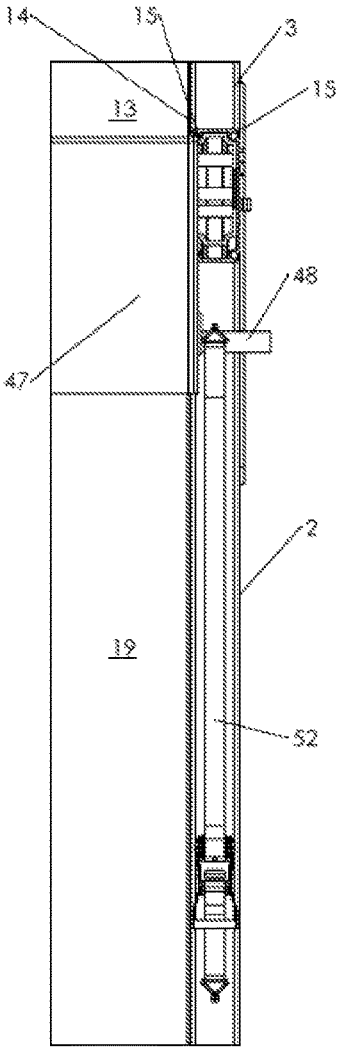
FIG. 24 shows an exemplary fabric connection for the clearspan structure.

With reference now to FIG. 20, the exemplary embodiment of a clearspan structure 1 has roof fabric 13 and fabric walls 19 for enclosing the clearspan structure 1 and frame. In the exemplary embodiment, roof fabric 13 and fabric walls 19 are double flap keder fabric having double flap reinforcement. As shown in FIGS. 21-22, the exemplary double flap keder fabric is formed by wrapping a first surface 17*a* and a second surface 17*b* of a keder material 17 around a dowel 16. The first surface 17*a* and second surface 17*b* surface of the keder material 17 are joined, for example by high-frequency RF welding, to form a secure pocket 18 for containing the dowel 16 and thereby form a keder edge 14 on the material.

In the exemplary embodiment of FIGS. 21-22, keder material 17 is a polyester 19 oz., white, denier 2000×2000 keder fabric with a thickness of 0.70 mm (0.0276 inches) and a coating thickness of 0.20 mm (0.0079 inches). In other embodiments, the keder material 17 may be any material consistent with the scope of this disclosure, for example and without limitation, a material that meets the American Petroleum Institute "Management of Hazards Associated with Location of Process Plant Tents," API Recommended Practice 756, First Edition (September 2014).

With continuing reference to FIG. 20, and further reference to FIGS. 23-29, roof fabrics 13 and fabric walls 19 are connected to frame members of the exemplary clearspan structure 1 to enclose the clearspan structure 1. In the exemplary embodiment shown by FIGS. 23-24, keder edges 14 of roof fabric 13 are received by, and lock into, keder tracks 15 in rafters 3. Roof fabric 13 extends over eave purlin 7 to form roof fabric flap 47. As shown in the exemplary cutaway view of fabric flap 47 in FIG. 25, the exemplary roof fabric flap 47 includes a pocket 51 formed, e.g., by looping the end of the roof fabric flap 47 and welding the loop in place. As further shown in the exemplary embodiment of FIGS. 24-25, a steel bar 48 passes through pocket 51 and is retained by a ratchet strap 52 attached to upright post 2, for keeping the roof fabric flap 47 and roof fabric 13 from flapping, moving, and/or becoming dislodged.

Figure 25:
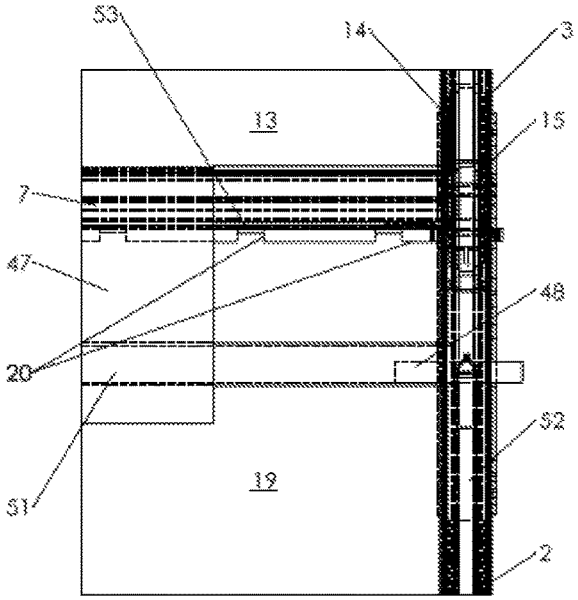
FIG. 25 shows an exemplary cutaway view of a fabric flap for the clearspan structure.
Figure 26:
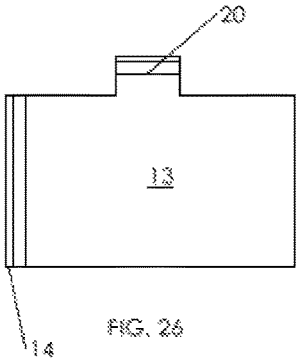
FIG. 26 shows an exemplary fabric wall for the clearspan structure.
Figure 27:
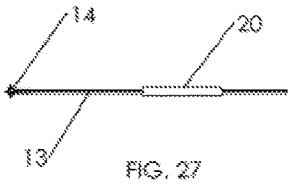
FIG. 27 shows a top view of an exemplary fabric wall for the clearspan structure.
Figure 28:
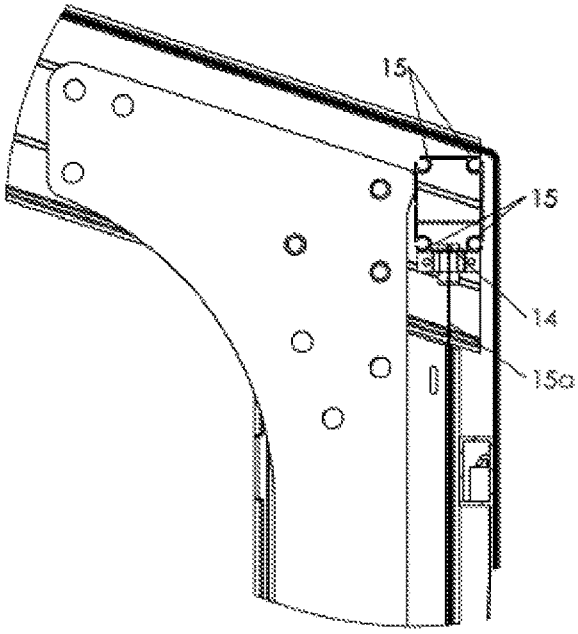
FIG. 28 shows an exemplary fabric connection for the clearspan structure.
Figure 29:
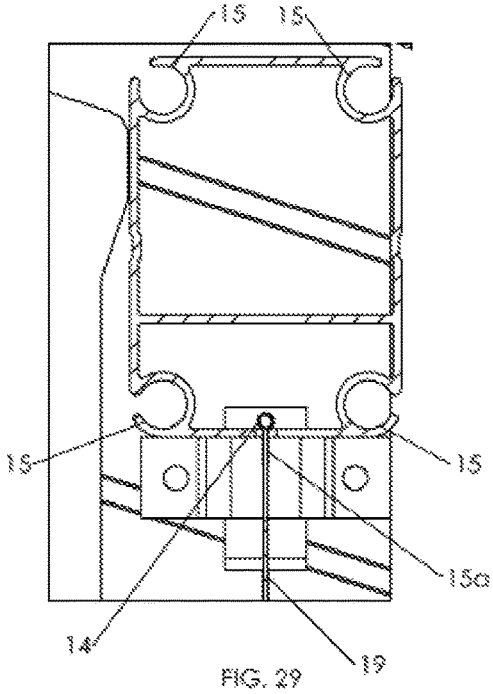
FIG. 29 shows an exemplary fabric connection for the clearspan structure.

With continuing reference to FIG. 25, and additional reference now to FIGS. 26-29, fabric walls 13 include keder edges 14 as previously described, and an edge having tabs 20 extending from the fabric wall 13. As shown in the exemplary embodiment of FIGS. 25-29, keder edges 14 of the fabric wall 13 are received by, and lock into, keder tracks 15*a* on the upright posts 2. Tabs 20 on the fabric wall 13 are received by, and lock into, a corresponding track 53 on eave purlins 7.

Figure 30:
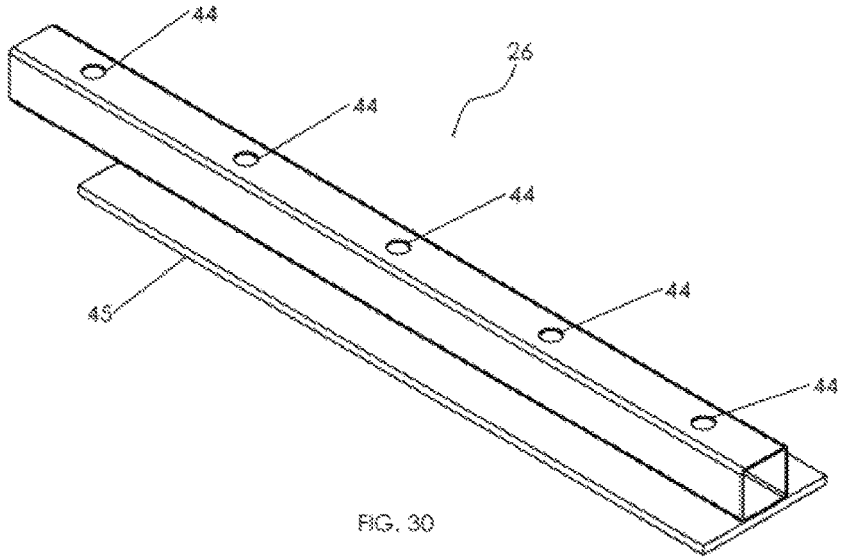
FIG. 30 shows an exemplary stake bar for the clearspan structure.
Figure 31:
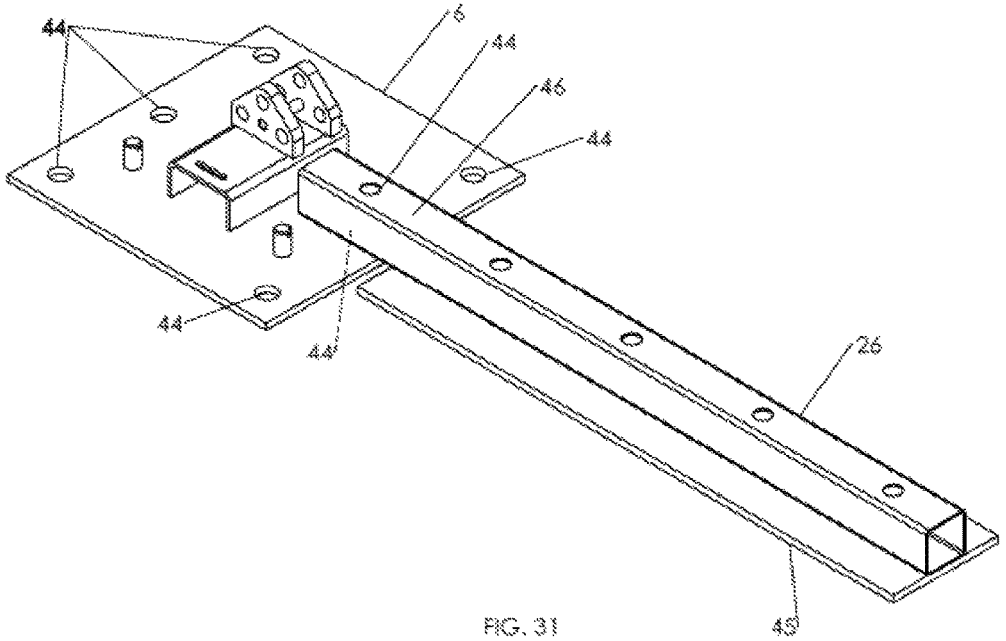
FIG. 31 shows an exemplary stake bar connection for the clearspan structure.

With reference now to FIGS. 30-31, the exemplary embodiment of a clearspan structure may further include stake bars 26 used with base plates 6 to increase resistance to uplift or shear forces on the clearspan structure 1. As shown in the exemplary embodiment of FIGS. 30-31, each stake bar 26 has additional anchoring apertures 44 for securing the stake bar 26 to a foundation or the ground.

As also shown in the exemplary embodiment of FIGS. 30-31, stake bar 26 includes stake bar platform 45 which elevates the stake bar 26 such that an overlapping portion 46 of stake bar 26 overlaps base plate 6. In this embodiment, overlapping portion 46 of stake bar 26 includes at least one anchoring aperture 44 that is aligned with an anchoring aperture 44 in base plate 6 such that an anchor may connect the stake bar 26 to each of the base plate 6 and a foundation or the ground. In this or other embodiments, base plates 6 may be integrally formed with stake bars 26 or connected by welding, bolting, or other known methods. Base plates 6 and stake bars 26 may also take any form or shape consistent with this disclosure.

In the exemplary embodiments, stake bars 26 are made from a galvanized steel such as according to standard A922 ("Standard Specification for Silicon Metal"). In other embodiments, stake bars may be made from other metals, alloys, plastics, or other materials consistent with this disclosure.

With reference now to FIGS. 1-2 and 32-35, the exemplary disclosed embodiment of a clearspan structure 1 may include cable braces 27 for providing additionally stability or resilience to the structure 1. An overall, exemplary configuration of cable braces 27 in the clearspan structure 1 may be seen in FIGS. 1 and 2. As shown in the exemplary embodiments of FIGS. 32-35, each cable brace 27 comprises a cable 28, turnbuckle 29, and cable console 30. In the exemplary embodiments of FIGS. 32-35, cable consoles 30 are bolted to frame members of the clearspan structure 1, and cables 28 are attached to the consoles using bolts through the eye end of an adjustable turnbuckle 29. Other known cable structures consistent with this disclosure may also be used.

Figure 32:
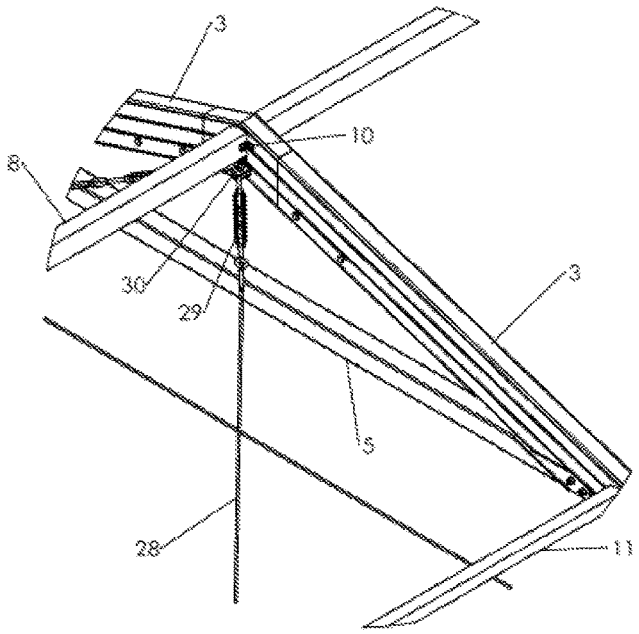
FIG. 32 shows an exemplary cable brace for the clearspan structure.
Figure 33:
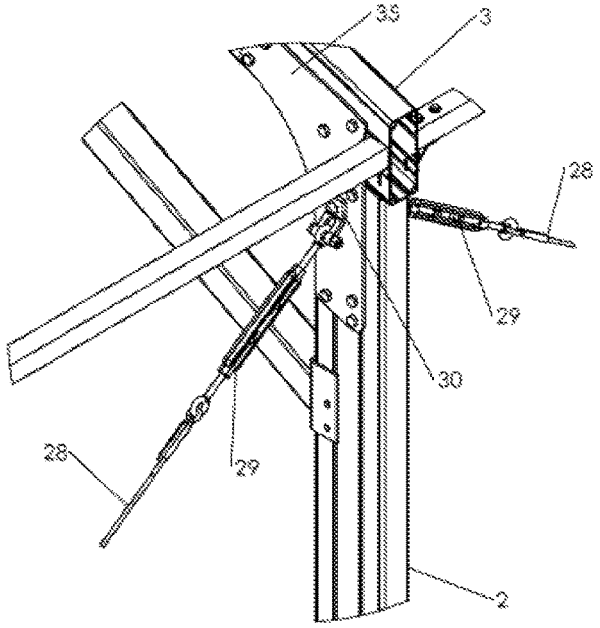
FIG. 33 shows an exemplary cable brace for the clearspan structure.
Figure 34:
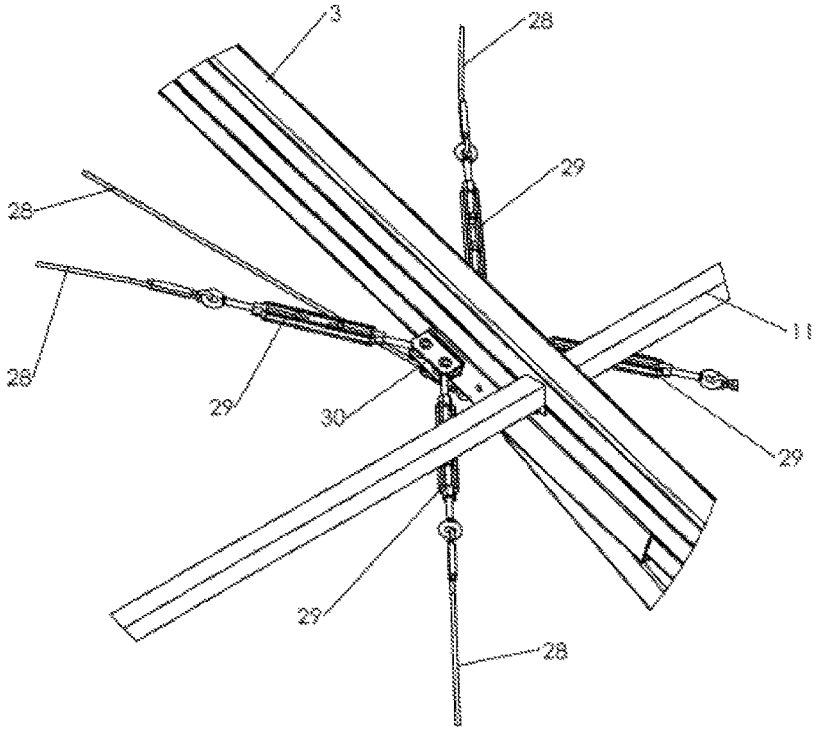
FIG. 34 shows an exemplary cable brace for the clearspan structure.
Figure 35:
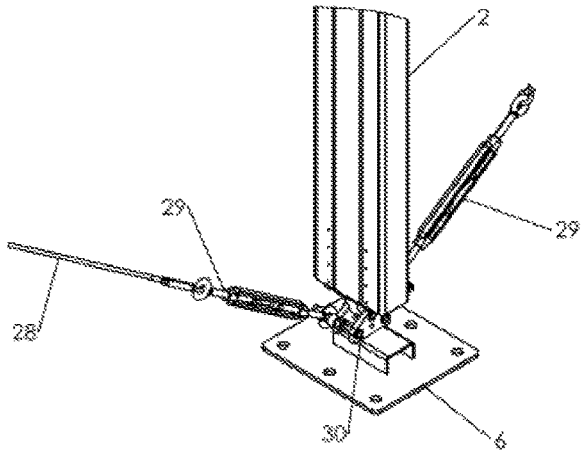
FIG. 35 shows an exemplary cable brace for the clearspan structure.

FIGS. 32-35 show cable brace 27 attachments at various locations in the clearspan structure 1. For example, FIG. 32 shows a cable console 30, turnbuckle 29, and cable 28 connected to rafters 3 at their intersection with a ridge purlin 8. FIG. 33 shows cable consoles 30, turnbuckles 29, and cables 28 connected to a bracket 35 joining an upright post 2 to a rafter 3. FIG. 34 shows cable consoles 30, turnbuckles 29, and cables 28 connected to a rafter 3 near an intermediate purlin 11. FIG. 35 shows a cable console 30, turnbuckles 29, and cables 28 connected to a base plate 6 beneath an upright post 2.

In the exemplary embodiments of FIGS. 32-35, cable braces 27 have steel bracing cables and components. In the same or other embodiments, the cable braces 27 may be formed from any suitable material, and connected at any particular locations, depending on the requirements for particular clearspan structures.

Figure 36:
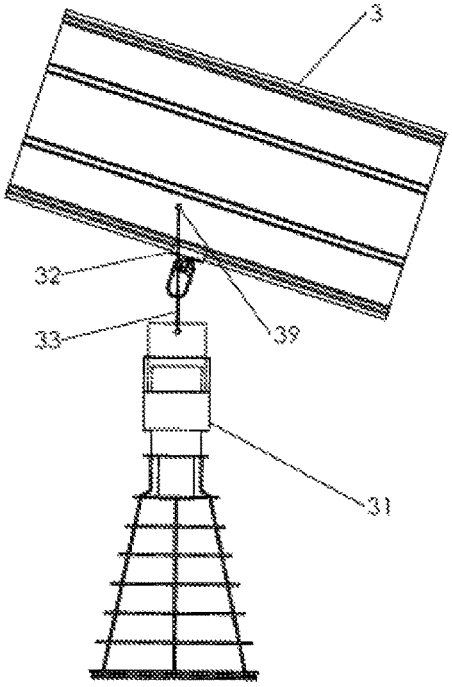
FIG. 36 shows an exemplary hanging light assembly for a clearspan structure.
Figure 37:
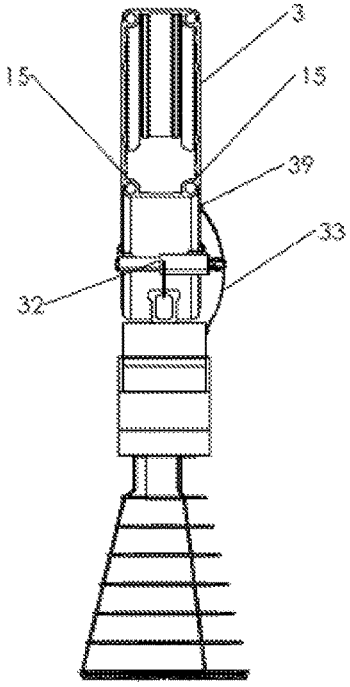
FIG. 37 shows an exemplary hanging light assembly for a clearspan structure; and, FIG. 38 shows an exemplary hanging light assembly for a clearspan structure.
Figure 38:
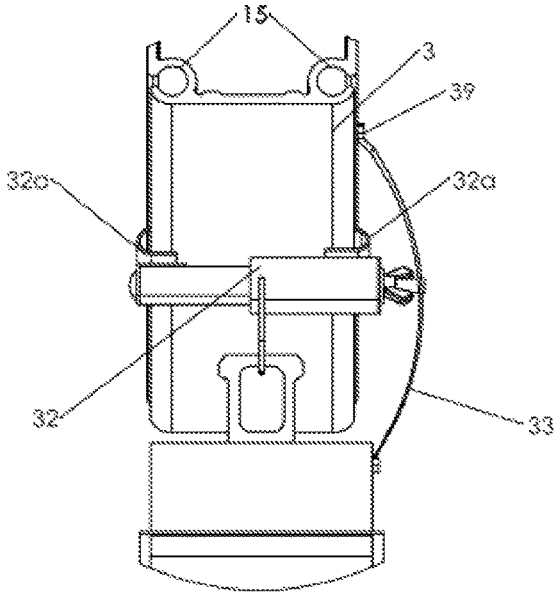

With reference now to FIGS. 36-38, the exemplary embodiment of a clearspan structure may further include a hanging light assembly 31. The hanging light assembly 31 is connected to a rafter 3 by a beam clamp 32 that is fastened to a keder track 15 on the bottom of the rafter 3 and a backup system consisting of a cable 33 connecting the light assembly 31 to the rafter 3. The hanging light assembly 31 may provide light within the clearspan structure, for example using a 400 watt metal halide light or other light source consistent with this disclosure.

In the exemplary embodiment shown by FIGS. 36-38, beam clamp 32 is a length-adjustable screw clamp with claws 32*a* configured to fit within and be clamped to keder tracks 15 of rafter 3. The exemplary cable 33 connecting the light assembly 31 to the rafter 3 is, in the exemplary embodiment, an 18 inch lanyard constructed out of a size No. 14 steel jack chain that is fastened to the side of the rafter with a size No. 14 self-tapping screw 39. In other embodiments, the hanging light assembly 31 may be secured to a frame member by any known means consistent with this disclosure, such as other clamping systems and mechanical connectors made from different materials, or means such as welding and screw/bolt-type fasteners.

An exemplary method of forming the disclosed exemplary clearspan structure will be generally understood from the foregoing description of an exemplary clearspan structure and component systems, and the materials, techniques, constructions, and assemblies described therein. The exemplary method includes securing stake bars 26 and base plates 6 to each other and to a foundation or the ground; connecting a first end of upright posts to base plates 6; connecting a second end upright posts 2 to a first end of rafters 3; connecting a second end of rafters 3 to ridge purlins 8; connecting eave purlins 7 to the first ends of rafters 3; connecting intermediate purlins 11 to rafters 3 in between the eave purlins 7 and ridge purlins 8; connecting brace bars 4 between connected upright posts 2 and rafters 3; and, connecting ridge struts 5 between opposing rafters 3.

The exemplary method may further comprise connecting fabric walls 19 to eave purlins 7; connecting roof fabrics 13 to rafters 3; and connecting roof fabric flaps 47 to ratchet straps 52 connected to upright posts.

The exemplary method may further comprise at least one of connecting cable braces 27 to frame members and connecting hanging light assemblies 31 to rafters 3.

In the exemplary or other embodiments, the method steps may be performed in any order, or not at all, consistent with this disclosure. Additional or alternative steps may also be performed within the scope of this disclosure, including the materials, techniques, constructions, and assemblies described with respect to the exemplary clearspan structure and component systems.

Although certain example embodiments have been described above, the present disclosure is not limited thereto. Also, the features, aspects, advantages, and example embodiments described herein may be combined to realize yet further embodiments. Further, the current disclosure covers various modifications and equivalent arrangements and methods included within the spirit and scope of the appended claims.

What is claimed is:

1. A tent, comprising:

at least first and second frame structures, each frame structure comprising:

a pair of upright posts, each upright post having a first end connected to a base plate secured to a foundation or a ground surface and a second end connected to a rafter, and a pair of rafters connecting at a first end to define a peak of each frame structure, each rafter having a second end that connects with a respective upright post and extends at an angle relative to the respective upright post;

a plurality of purlins, each purlin extending between two rafters of adjacent frame structures;

a plurality of first and second support members, wherein each of the first support members is provided between the peak of the first frame structure and the second end of the respective upright post of the second frame structure, such that each of the first support members extends diagonally within a plane defined by ridge purlins, corresponding rafters and eave purlins of the first and second frame structures, and each of the second support members extends diagonally between two adjacent upright posts of two said adjacent frame structures; and at least one roof fabric having keder edges that are received by at least one keder track installed on at least one of the two rafters, such that the at least one roof fabric extends between the two rafters.

2. The tent of claim 1, wherein the at least one roof fabric extends over at least one of the plurality of purlins.

3. The tent of claim 1, wherein each of the first support members is connected to a rafter of a third frame structure that is positioned between the first and second frame structures.

4. The tent of claim 1, further comprising a plurality of the frame structures that are spaced in a selected increment across a span width of the tent.

5. The tent of claim 1, wherein the plurality of purlins comprise a plurality of eave purlins, each eave purlin extending between two adjacent upright posts via the second end of each upright post.

6. The tent of claim 4, further comprising a plurality of ridge purlins, each ridge purlin connecting two adjacent frame structures via the peak of each frame structure.

7. The tent of claim 5, wherein the plurality of purlins comprise a plurality of intermediate purlins, each intermediate purlin bridging two adjacent rafters between a respective eave purlin and ridge purlin.

8. The tent of claim 1, further comprising at least one wall fabric having keder edges that are received by at least one keder track installed on at least one of two adjacent upright posts of two adjacent frame structures, such that the at least one wall fabric extending between the two adjacent upright posts.

9. The tent of claim 8, wherein the at least one wall fabric further comprises an edge having a plurality of tabs received and secured by an eave purlin between the two adjacent upright posts.

* * * * *